US012281565B2

(12) United States Patent
Hu et al.

(10) Patent No.: US 12,281,565 B2
(45) Date of Patent: Apr. 22, 2025

(54) SCALING AND PLUGGING DETECTION IN ARTIFICIAL LIFT APPLICATION

(71) Applicant: Halliburton Energy Services, Inc., Houston, TX (US)

(72) Inventors: Yuzhu Hu, Tulsa, OK (US); Frank Corredor, Houston, TX (US); Clara Susana Tandazo Castro, Houston, TX (US); Hans Sjerps, Amsterdam (NL)

(73) Assignee: Halliburton Energy Services, Inc., Houston, TX (US)

( * ) Notice: Subject to any disclaimer, the term of this patent is extended or adjusted under 35 U.S.C. 154(b) by 153 days.

(21) Appl. No.: 18/193,415

(22) Filed: Mar. 30, 2023

(65) Prior Publication Data

US 2024/0328302 A1 Oct. 3, 2024

(51) Int. Cl.

| | |
|---|---|
| ***E21B 47/008*** | (2012.01) |
| ***E21B 37/06*** | (2006.01) |
| ***E21B 43/12*** | (2006.01) |
| ***E21B 47/00*** | (2012.01) |
| ***E21B 47/06*** | (2012.01) |

(52) U.S. Cl.

CPC ..... *E21B 47/008* (2020.05); *E21B 37/06* (2013.01); *E21B 43/128* (2013.01); *E21B 47/006* (2020.05); *E21B 47/06* (2013.01)

(58) Field of Classification Search

CPC ..... E21B 47/008; E21B 37/06; E21B 43/128; E21B 47/006; E21B 47/06

See application file for complete search history.

(56) References Cited

U.S. PATENT DOCUMENTS

| | | | | |
|---|---|---|---|---|
| 6,937,923 | B1 * | 8/2005 | Bassett | E21B 34/16 700/285 |
| 11,236,751 | B2 | 2/2022 | Nguyen et al. | |
| 11,609,353 | B2 | 3/2023 | Jain et al. | |
| 2005/0173112 | A1 | 8/2005 | Kavaklioglu et al. | |

(Continued)

FOREIGN PATENT DOCUMENTS

| | | |
|---|---|---|
| CN | 108756817 | 11/2018 |
| KR | 101160678 | 6/2012 |

(Continued)

OTHER PUBLICATIONS

"PCT Application No. PCT/US2023/065293, International Search Report and Written Opinion", Dec. 20, 2023, 16 pages.

(Continued)

*Primary Examiner* — James G Sayre

(74) *Attorney, Agent, or Firm* — DeLizio, Peacock, Lewin & Guerra LLP

(57) ABSTRACT

Some implementations include a method for controlling a computer system configured to detect scaling and/or plugging of an electric submersible pump (ESP) deployed in a wellbore. The method may include determining, based on a measurement of pressure in the wellbore, a required total dynamic head (RTDH) for the ESP while the ESP is operating in the wellbore. The method also may include determining, based on information from one or more sensors in the ESP, a produced total dynamic head (PTDH) for the ESP while the ESP is operating in the wellbore. The method also may include detecting scaling status or plugging status of the ESP based on the RTDH and the PTDH.

20 Claims, 9 Drawing Sheets

(56) References Cited

U.S. PATENT DOCUMENTS

| | | | | |
|---|---|---|---|---|
| 2007/0183902 | A1* | 8/2007 | Stiles | F04D 13/06 417/42 |
| 2011/0106452 | A1 | 5/2011 | Anderson et al. | |
| 2013/0151156 | A1 | 6/2013 | Noui-Mehidi et al. | |
| 2022/0090485 | A1 | 3/2022 | Boguslawski et al. | |
| 2022/0098971 | A1 | 3/2022 | Raglin et al. | |
| 2022/0221826 | A1* | 7/2022 | Nguyen | G05D 7/0676 |
| 2023/0186627 | A1 | 6/2023 | Shao et al. | |
| 2023/0235646 | A1* | 7/2023 | Wang | E21B 37/06 166/304 |
| 2024/0110473 | A1* | 4/2024 | Hu | E21B 43/38 |
| 2024/0169252 | A1* | 5/2024 | Harrington | G08B 21/18 |

FOREIGN PATENT DOCUMENTS

| | | |
|---|---|---|
| WO | 2021252416 | 12/2021 |
| WO | 2023009741 | 2/2023 |
| WO | 2023056120 | 4/2023 |
| WO | 2024205647 | 10/2024 |

OTHER PUBLICATIONS

"PCT Application No. PCT/US2023/027253 International Search Report and Written Opinion", Nov. 7, 2023, 8 pages.

Ahmed, et al., "Automatic Well Testing and PIP Calculations Using Smart Rod Pump Controllers", Feb. 20, 2012, 14 pages.

El-Saghier, et al., "A model for calculating bottom-hole pressure from simple surface data in pumped wells", Feb. 24, 2020, 9 pages.

Xian, et al., "A New Method Of Bhp Measurement In Esp Deadhead Test", Mar. 25, 2014, 9 pages.

"PCT Application No. PCT/US2023/068689, International Search Report and Written Opinion", Mar. 6, 2024, 10 pages.

* cited by examiner

SCALING AND PLUGGING DETECTION IN ARTIFICIAL LIFT APPLICATION

TECHNICAL FIELD

The disclosure generally relates to the field of equipment utilized and operations performed in drilling and operating subterranean wells and more specifically to detecting scaling and plugging of electric submersible pumps.

BACKGROUND

In artificial lift applications, scale formation and intake plugging may occur on an electrical submersible pump (ESP). Detection of scaling and plugging may help avoid problems such as poor performance and failure of the ESP. In some situations, after detecting scaling and/or plugging, operators may take remedial action to reduce the scaling and/or plugging, such as by applying a chemical treatment in the wellbore. Standard downhole sensors do not indicate the extent of any scaling or plugging. Therefore, alternative approaches are needed for detecting scaling and/or plugging in artificial lift applications.

BRIEF DESCRIPTION OF THE DRAWINGS

Implementations of the disclosure may be better understood by referencing the accompanying drawings.

DESCRIPTION OF IMPLEMENTATIONS

Figure 1:
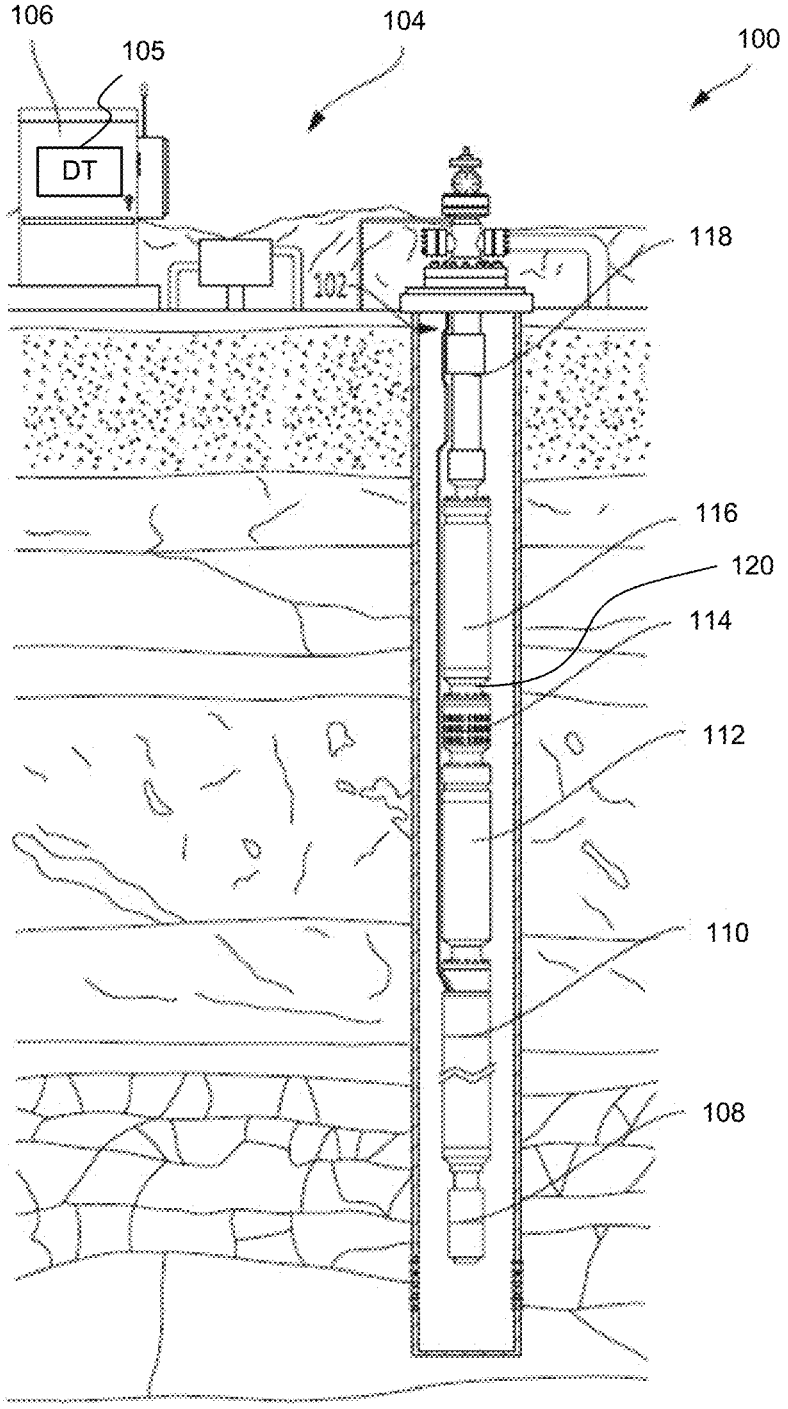
FIG. 1 is a schematic representation of a well environment 100 in a production phase.

The description that follows includes example systems, methods, and program flows that embody embodiments of the disclosure. However, this disclosure may be practiced without these specific details. For clarity, some well-known instruction instances, protocols, and structures may not be shown in detail.

Overview

Before an electric submersible pump (ESP) is deployed in a production system, a sizing calculation may be performed to ensure the ESP will meet the lift requirement of the production system. The sizing calculation may include calculating required total dynamic head (TDH) for the ESP. The required TDH may be determined by summing-up values including net vertical lift, tubing friction loss, and tubing head pressure. Net vertical lift may indicate the vertical distance between a fluid level in a wellbore and the ESP's discharge point. Tubing friction loss may indicate a loss resulting from flow disturbance in the tubing string during the pumping process. Tubing head pressure may indicate a pressure against which the ESP must pump (such as back pressure caused by choking on the well head).

Typically, the sizing calculation (such as required TDH) is performed only before and not after selecting and deploying the ESP. However, some implementations of the inventive subject matter may determine the required TDH after selection and deployment of the ESP. Some implementations may utilize a dynamic tracker that repeatedly calculates required TDH as the ESP operates. The required TDH at a particular time may be computed based on the net vertical lift, tubing friction loss, tubing head pressure, and formation pressure in the wellbore. In some implementations, a sensor in the wellbore may indicate the formation pressure in the wellbore. The required TDH indicates the lift needed to pump the fluid to the surface based on the conditions at the time. For example, the required TDH may be 1200 feet based on the reservoir pressure and other conditions at the time.

The dynamic tracker also may repeatedly calculate a produced TDH which indicates a TDH produced by the ESP at a particular time (while the ESP is operating). For example, while the ESP is operating, the dynamic tracker may determine the ESP's produced TDH at a particular time is 1800 feet. In some situations, the required TDH and produced TDH may be very close to each other under normal conditions. If the required TDH and produced TDH deviate from each other, the ESP may have a scaling and/or plugging issue. For example, if required TDH is 1200 feet and the produced TDH is 1800 feet, the ESP may be overworking because its intake may be plugged or its components obstructed by scaling. Such a plugged or scaled ESP intake may reduce the effects of formation pressure which would have assisted the ESP. Hence, while an ESP is operating, some implementations detect scaling or plugging of the ESP based on differences in required TDH and the produced TDH. For example, if the ratio of required TDH to produced TDH (required TDH/produced TDH) is less than 0.85, the dynamic tracker may indicate that the ESP has a scaling or plugging issue. As another example, if the ratio of required TDH to produced TDH is 1, the dynamic tracker may indicate that there is no scaling and/or plugging issue. If the dynamic tracker indicates a scaling or plugging issues, operators may take remedial measures (such as by applying chemical treatments) before any significant reduction in performance of the ESP.

Some Example Implementations

Example Well Environment

FIG. 1 is a schematic representation of an example well environment 100 in a production phase. The well environment 100 can represent an applicable environment in which a substance may be pumped through the wellbore 102 toward the surface. For example, the well environment 100 may represent a hydrocarbon production environment in which hydrocarbons are pumped through the wellbore 102 toward the surface. In another example, the well environment 100 may represent a geothermal environment in which water may be pumped through the wellbore 102 toward the surface.

The well environment 100 includes a production system 104 disposed in relation to the wellbore 102. The production system 104 may include a surface control system 106. The production system 104 also may include components disposed downhole in the wellbore 102. Specifically, the production system 104 may include a gauge 108, a motor 110, a seal section 112, a gas separator 114, an intake 120, a pump 116, and a power cable 118. The components of the production system 104, in combination, may function to form various tasks related to pumping a substance through the wellbore 102 toward the surface. In particular, the surface control system 106 may function to control and interact with the various downhole components for performing various tasks related to pumping a substance through the wellbore 102 towards the surface. The surface control system 106 may include a dynamic tracker 105 configured to determine pressures, flows, and other properties of the production system 104. Although shown as a part of the surface control system 106, the dynamic tracker 105 may reside in any suitable location, such as on any suitable remote computer system accessible via a wired or wireless telecommunications network.

The gauge 108 may function to generate downhole data of one or more monitored parameters. Specifically, the downhole data may include any suitable data that may be measurable downhole. When a first component or first point is described as being before a second component or second point, the first component or point may be positioned further in a wellbore than a second component or point. For example, the gauge 108 may include a pressure gauge that is configured to identify a wellbore pressure before the pump 116 (such as before the intake or gas separator 114). In some implementations, the gauge 108 supplies wellbore pressure measurements used in determining the required TDH. Hence, in some implementations, the dynamic tracker 105 utilizes a wellbore pressure measurement to determine the required TDH at given time. The determination of required TDH may be used in a method for detecting plugging and/or scaling of the ESP. Such a method also may utilize a value for produced TDH of the ESP in detecting the plugging and/or scaling of the ESP (described in greater detail below).

Additionally, the gauge 108 may function to measure parameters for preventing or reducing formation damage caused by overproduction through the wellbore 102. The gauge 108 may communicate with the surface control system 106 in generating downhole data. Specifically, the gauge 108 may provide the downhole data as telemetry data to the surface control system 106, where the downhole data may be used in controlling production operation of the production system 104.

The motor 110 functions to drive the pump 116. Specifically, the motor 110 may receive power from the surface through the power cable 118 to drive the pump 116 in lifting production substance towards the surface. The motor 110 may be an applicable motor that may drive the pump 116. Correspondingly, the pump 116 may be an applicable pump that is capable of pumping production substances toward the surface of the wellbore 102, such as an ESP. The seal section 112 is disposed between the motor 110 and the intake of the pump 116. The seal section 112 functions to isolate the motor 110 from downhole fluids. The seal section 112 also may function to equalize pressure in the wellbore 102 with pressure in the motor 110.

The gas separator 114 is positioned between the pump 116 and the sealing section 112 and motor 110 combination. The gas separator 114 may serve, at least in part, as an intake for the pump 116. In particular, the gas separator 114 may function to separate gas from fluid in the wellbore and allow for the entry of the separated fluid into the pump 116. In turn, the pump 116 may pump the separate fluid toward the surface as part of a production substance. The separated fluid that is fed to the pump 116 may include portions of the separated gas that are broken down and incorporated into the fluid to form a more homogenized solution.

Specifically, the disclosure now continues with a discussion of methods for predicting intake loss and identifying downhole pressures based on the predicted intake loss. Various metrics are discussed in relation to the methods for predicting intake loss and identifying downhole pressures based on the predicted intake loss. These metrics include metrics associated with a production system, such as production system 104, disposed in a wellbore in relation to a pump of the production system. Some of these metrics may indicate the pump's produced TDH which may be used in methods for detecting scaling and/or plugging of the pump 116.

Figure 2:
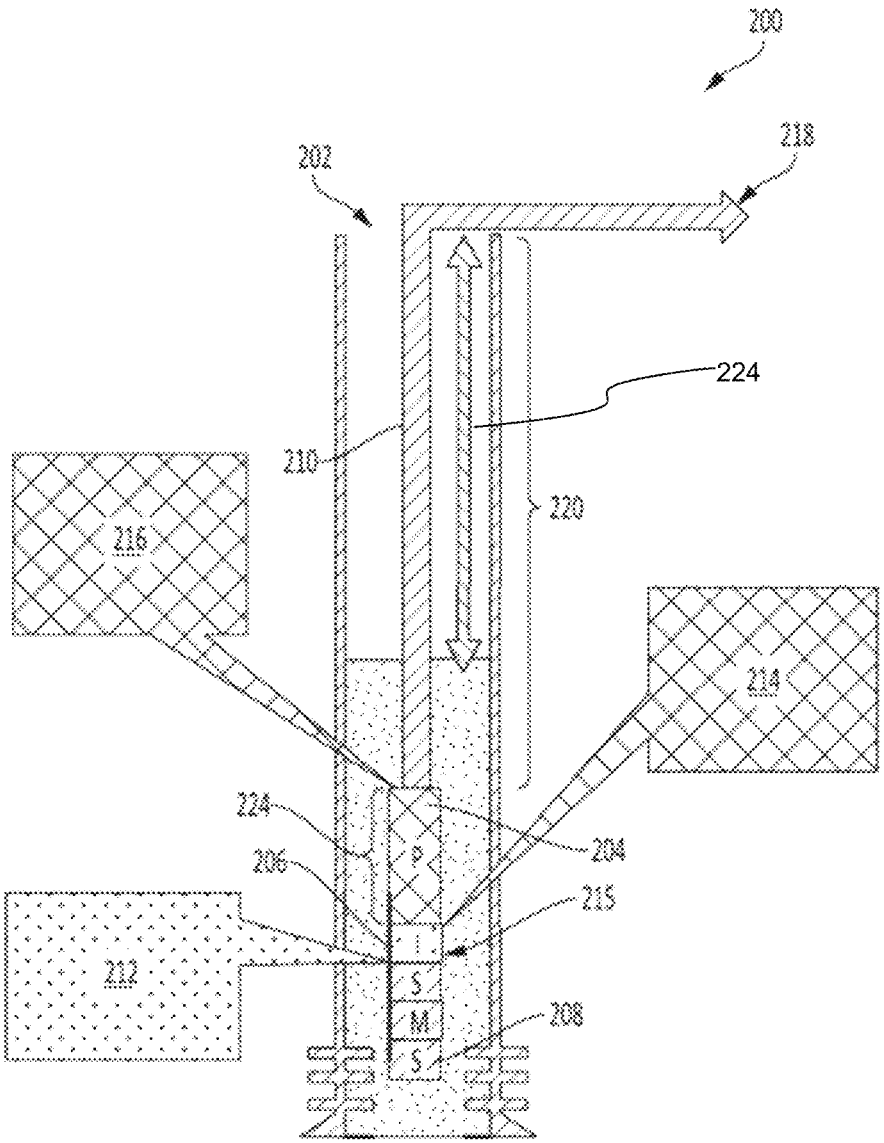
FIG. 2 illustrates a schematic representation of a production system 200 in a wellbore 202.

FIG. 2 illustrates a schematic representation of a production system 200 in a wellbore 202. FIG. 2 includes indicated metrics in relation to the production system 200 in the wellbore 202 for identifying downhole pressure based on a predicted intake loss. The production system 200 may be any suitable production system for pushing production substances toward the surface, such as the production system 104. Further, the production system 200 shown in FIG. 2 may include more components than shown.

The production system 200 may include a pump 204, an intake 206 for the pump 204, a gauge 208, and production tubing 210. The methods described herein may be applied to identify a pump intake pressure before the intake 212. Specifically, the methods described herein may be applied to identify a pump intake pressure before the intake 212 based on a predicted intake loss of the intake 206. The pump intake pressure before the intake 212 may correspond to a monitored wellbore pressure. Specifically, the pump intake pressure before the intake 212 may correspond to a wellbore pressure that is monitored by the gauge 208. Accordingly, the pump intake pressure before the intake 212 may serve as a substitute for a pressure monitored by the gauge 208 (such as in the case of gauge 208 failure). Further, the pump intake pressure before the intake 212 may serve to validate a pressure that is calculated based on data measured by the gauge 208. The gauge 208 may provide wellbore pressure measurements to the dynamic tracker 105 which may utilize the wellbore pressure measurements to determine a required TDH of the pump 204. The dynamic tracker 105 may use the required TDH in method for detecting scaling and/or plugging of the pump 204 based, in part, on the required TDH of the pump 204.

The methods applied herein also may be applied to identify a pump intake pressure after the intake 214. The pump intake pressure after the intake 214 is a pressure after the intake 206 and before the pump 204 in a flow of substance through the intake 206 and into the pump 204. As will be discussed in greater detail later, the pump intake pressure after the intake 214 may be used in identifying the pump intake pressure before the intake 212. Specifically, the pump intake pressure before the intake 212 may be the sum of the pump intake pressure after the intake 214 and an intake loss 215 that is created in the intake 206.

The intake loss 215 is representative of loss associated with production substance flow in the intake 206, through the intake 206, and out the intake 206, but also expected to include the friction loss and minor loss associated with the fluid flow in wellbore 202 annulus (such as loss up to intake 206). This loss may be created due to applicable factors that affect substance flow in relation to a pump intake. Specifically, the intake loss 215 may be caused by loss through the intake 206 due to changing cross sectional areas associated with the intake 206 and through which fluid flows. For example, the intake loss 215 may be caused by a narrowing fluid channel through the intake 206. Further, the intake loss 215 may be caused by friction loss associated with fluid passing through the intake 206. For example, the intake loss 215 may be caused by friction loss as a substance interacts with surfaces of the intake 206 as the substance flows through the intake 206.

Further, intake loss, as used herein, is not strictly limited to a pump intake but may include other applicable related downhole losses that affect downhole flow of a production substance. These downhole pressure head losses may include losses that are created after the intake (such as towards production reservoirs). For example, intake loss may include losses created by friction with the casing of the wellbore. The intake loss 215 may also be friction loss due to changing cross sectional areas associated with the wellbore flow path (such as due to annules cross sectional areas change).

The methods applied herein may also be applied to identify a discharge head 216 of the pump 204. A discharge head of a pump, as used herein, is a pressure metric or other representation of pressure at the discharge of the pump 204. For example, the discharge head 216 of the pump 204 may be represented as the vertical distance that a pump may pump a substance. More specifically, the discharge head 216 may indicate that the pump 204 may pump a substance 25 vertical feet.

The discharge head 216 of the pump 204 may depend on numerous parameters. Specifically, and as will be discussed in greater detail later, the discharge head 216 of the pump may depend on a wellhead head parameter 218, a tubing loss parameter 220, and a static head parameter. The wellhead head parameter 218 is a pressure metric or other representation at a wellhead of the wellbore 202. The tubing loss parameter 220 is a loss that is introduced in pumping the substance from the pump 204 to the wellhead of the wellbore 202 through the production tubing 210. For example, the tubing loss parameter 220 may include the amount of friction loss that is created by pumping through the production tubing 210. The static head parameter is the head required to push the production substance from the flowing production substance level to the surface.

The methods applied herein may be applied to identify a TDH 224 for the pump 204. The TDH 224 is a metric that represents the total distance that the pump 204 may pump a substance when viewed in the entire production system 200. The TDH 224 is a function of both the operating frequency of the pump 204 and the flow rate associated with the pump 204.

Example Operations

Some implementations may use various methods for determining the ESP's required TDH and produced TDH. For example, some implementations may determine required TDH and produced TDH by predicting intake loss of the production system 100 and identifying a downhole pressure based on the predicted intake loss.

Figure 3:
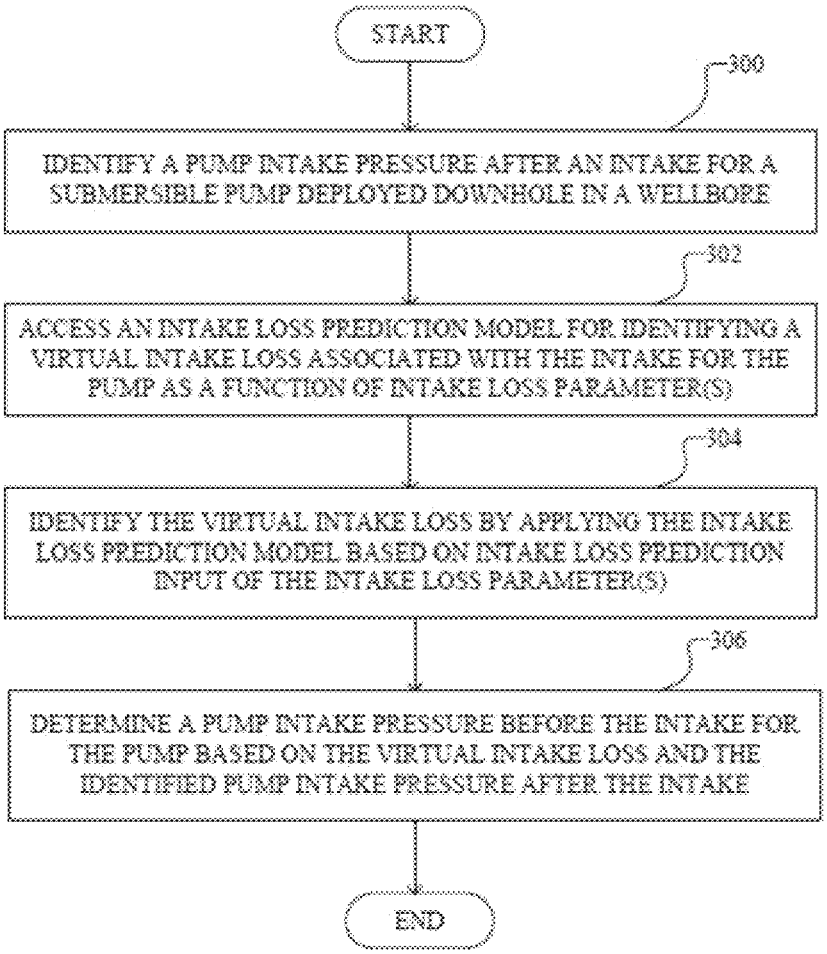
FIG. 3 illustrates a flowchart for an example method of identifying downhole pressure based on a predicted intake loss.

FIG. 3 illustrates a flowchart for an example method of identifying downhole pressure based on a predicted intake loss. At block 300, a pump intake pressure after an intake for a submersible pump deployed in a wellbore may be identified. More specifically and with reference to FIG. 2, the pump intake pressure after the intake 214 may be identified. While the technology described herein is discussed with respect to a pump intake, the methods described herein may be applied to a gas separator in a production system. The pump intake pressure after the intake may be identified through an applicable method for identifying pressure after an intake in a downhole environment. Specifically, the pump intake pressure after the intake may be identified through various monitored parameters, calculated parameters, and specified parameters. For example, and as will be discussed in greater detail later, the pump intake pressure after the intake may be identified based on a static head parameter, a tubing loss parameter, and a wellhead head parameter. In various implementations, the pump intake pressure after the intake may be identified using another applicable method.

Further, the pump intake pressure after the intake may be identified based on a TDH parameter. As a TDH parameter may be dependent on both the flow rate and operational frequency, the pump intake pressure after the intake may be dependent on such operational parameters. For example, the pump intake pressure after the intake may be identified based on a number of pump stages at specific operational frequencies of a production system. Specifically, the pump intake pressure after the intake may be identified based on the pump head per stage at specific operational frequencies.

At block 302, an intake loss prediction model for identifying a loss associated with the intake for the pump, otherwise referred to as a virtual intake loss, may be accessed. An intake loss identified by the intake loss prediction model may be a predicted intake loss that will occur at a different time (such as in the future). Further, an intake loss identified by the intake loss prediction model may be an intake loss that is determined in real time. Real time, as used herein, may include actual time, virtually immediately, or within a threshold range to actual time. Real time may include calculations made with respect to the last time data was measured downhole by one or more sensors. Regardless of whether the model is used to predict an intake loss at a different time or identify an intake loss in real time, an intake loss that is identified through the model may be referred to as a virtual intake loss. Specifically, an intake loss determined through the model may be a virtual intake loss as, in various implementations, it is not directly identified from measurements used to calculate a downhole pressure before the intake.

An intake loss prediction model is a model that relates intake loss to one or more intake loss parameters. More specifically, and with reference to FIG. 2, an intake loss prediction model may model the intake loss 215 as a function of one or more intake loss parameters. As discussed previously, the intake loss 215 is representative of a loss associated with production substance flow into the intake 206, a loss associated with production substance flow through the intake 206, and loss associated with production subset flow out of the intake 206. Further, the intake loss 215 may also include other applicable downhole losses (such as associated with the intake). Accordingly, an intake loss prediction model may model an applicable combination of these losses as a function of one or more intake loss parameters.

Intake loss parameters, as used herein, may be applicable parameters that affect intake loss in a production system. The parameters may be monitored parameters. For example, intake loss parameters may include a flowrate parameter associated with a flowrate through a production system, a frequency parameter associated with an operational frequency of a production system, and a wellhead head parameter associated with a pressure at a wellhead of a wellbore. Further, the parameters may be calculated parameters. For example, the parameters may include a tubing loss parameter associated with loss through production tubing of a production system and a TDH parameter associated with a TDH of a production system. Intake loss parameters may also include a wellhead temperature parameter, a flowline pressure parameter, an injection pressure parameter, an injection temperature parameter, a differential pressure parameter, a valve choke parameter, a surface valve opening parameter, a motor current parameter, a motor voltage parameter, and other applicable downhole and surface parameters.

An intake loss prediction model, as will be described in greater detail later, may be a physical model. A physical model may be generated based only on an intake loss parameter of flowrate. Specifically, a physical model may model intake loss at a varying flow rate to account for major losses and minor losses associated with a pump intake. Major losses may correspond to well friction losses and be modeled according to Darcy's equation. In various implementations, a physical model may be created using other methods. Minor losses may correspond to losses created by sudden expansions, contractions, and fittings. A physical model may be generated based on one or more applicable intake loss parameters, such as the previously described intake loss parameters.

Further, an intake loss prediction model, as will be described in greater detail later, may be a machine learning-based model. Specifically, a machine learning-based model may model intake loss based on varying intake loss parameters of a flowrate parameter, a frequency parameter, a wellhead head parameter, a tubing loss parameter, a pump head parameter, a wellhead temperature parameter, a flowline pressure parameter, an injection pressure parameter, an injection temperature parameter, a differential pressure parameter, a valve choke parameter, a surface valve opening parameter, a motor current parameter, a motor voltage parameter, or a combination thereof. These parameters are merely examples, and different parameters may be used. Further, fewer, or more parameters may be used. As the machine learning-based model may account for the different intake loss parameters, the machine learning-based model may perform functions that are not easily performed by a human. Specifically, modeling intake loss across the ranges of these numerous intake loss parameters is difficult for a human to perform in their own mind. Further, by accounting for different intake loss parameters and not just flowrate, the machine learning-based model may account for previously described downhole losses that are called intake losses for the purposes of this disclosure, but that are not limited the losses occurring in a pump intake. In turn, this may increase an overall accuracy of an intake loss prediction model, such as in comparison to a model that is purely a physical model.

An intake loss prediction model may be generated based on a calculated intake loss. Calculated intake loss, as used herein, is an intake loss that is calculated directly from measurements associated with one or more downhole sensors, one or more surface sensors, one or more installation conditions, or a combination thereof. Specifically, an intake loss prediction model may be generated based on a measured pump intake pressure before the intake. More specifically and with reference to FIG. 2, the intake loss prediction model may be generated based on a calculated intake loss that is identified from the pump intake pressure before the intake 212 that is directly measured by the gauge 208. Further and as will be discussed in greater detail later, the intake loss prediction model may be generated based on a pump intake pressure after intake that is calculated from measurements. Specifically, the intake loss prediction model may be generated based on a calculated intake loss that is identified from the pump intake pressure after intake 214 that is calculated from measurements.

At block 304, the virtual intake loss may be identified by applying the intake loss prediction model based on intake loss prediction input of the intake loss parameters. Intake loss prediction input, as used herein, includes values of the intake loss parameters that may be applied to the intake loss prediction model for determining an intake loss. For example, intake loss prediction input may include values of a flowrate parameter, a frequency parameter, a wellhead head parameter, a tubing loss parameter, a pump head parameter, other applicable intake loss parameters, such as the other intake loss parameters described herein, or a combination thereof.

The intake loss prediction input that is applied to the intake loss prediction model may depend on whether the model is a physical model or a machine learning-based model. Specifically, the intake loss prediction input that is applied to the intake loss prediction model may depend on the intake loss parameters that are used in generating the intake loss prediction model. For example, if a flowrate parameter is used to generate the intake loss prediction model, such as a physical model, then values of the flowrate parameter may serve as the intake loss prediction input to the model. In another example, if a flowrate parameter, a frequency parameter, a wellhead head parameter, a tubing loss parameter, a pump head parameter, or a combination thereof are used to generate the intake loss prediction model, such as a machine learning-based model, then values of these corresponding parameters may serve as the intake loss prediction input to the model.

The intake loss prediction input may have a temporal aspect. Specifically, the intake loss prediction input may correspond to values of intake loss parameters at a specific time or time frame. In turn, the virtual intake loss that is identified based on the intake loss prediction input may correspond to the specific time or time frame. Accordingly, intake loss prediction input may be identified in real time and applied to identify a virtual intake loss for a production system in real time.

At block 306, a pump intake pressure before the intake may be determined for the pump/pump system based on the identified virtual intake loss. Specifically, the pump intake pressure before the intake may be determined based on the virtual intake loss and the identified pump intake pressure after the intake. More specifically and with reference to FIG. 2, the pump intake pressure before the intake 212 may be determined based on the identified virtual intake loss 215 and the identified pump intake pressure after the intake 214.

While an intake loss prediction model may be generated based on a measured pump intake pressure before intake, the intake loss prediction model may be applied to identify a virtual intake loss. In turn, the virtual intake loss may be applied to determine a pump intake pressure before the intake that is distinct from the measured pump intake pressure before intake. As follows, this determined pump intake pressure before the intake may be referred to as a virtual pump intake pressure because, in various implementations, it is not measured or otherwise calculated directly from measurements and instead determined from a predicted intake loss or an intake loss calculated, such as in real time, from a model. By being distinct from the measured pump intake pressure, the virtual pump intake pressure may serve to validate the measured pump intake pressure. Further, by being distinct from the measured pump intake pressure, the virtual pump intake pressure may supplement the measurement.

Figure 4:
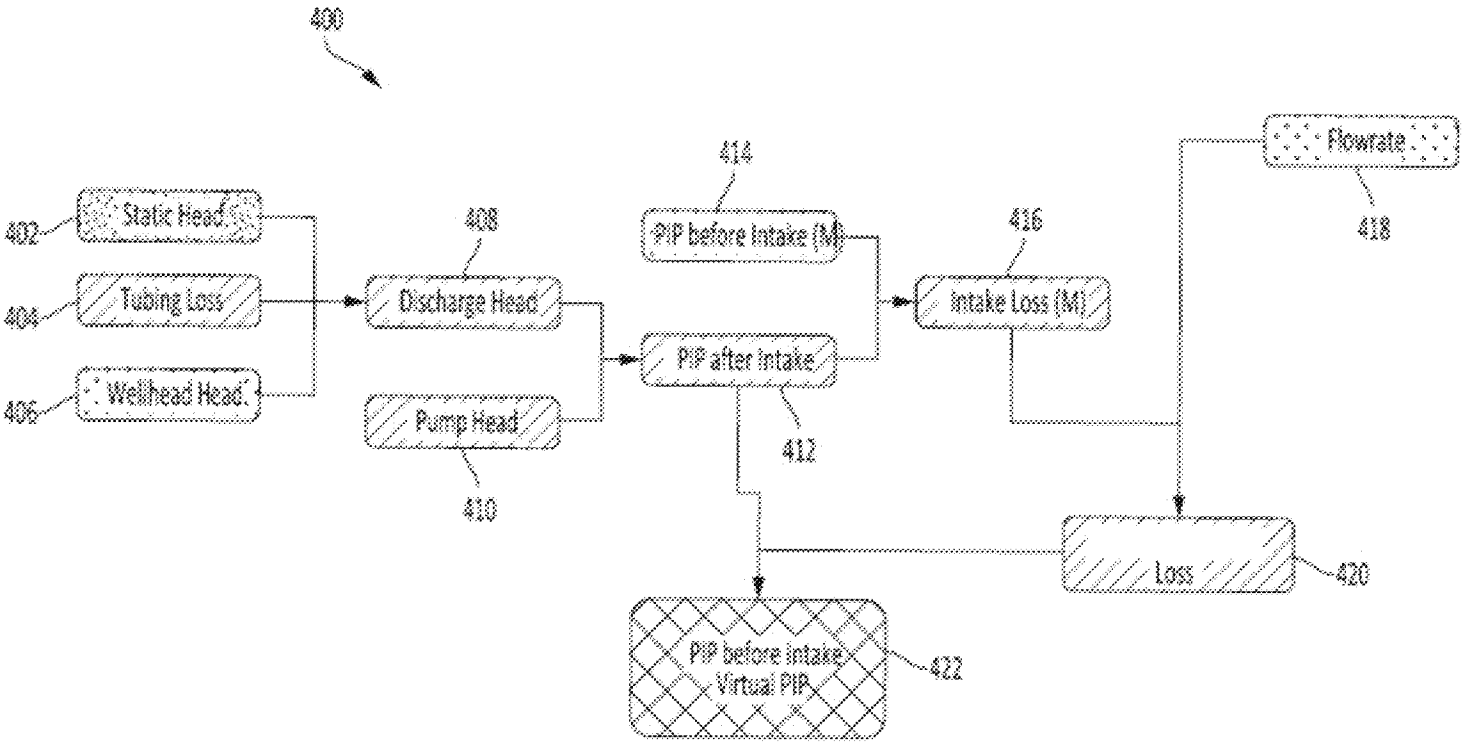
FIG. 4 is a schematic representation of a flow for identifying a pump intake pressure before an intake for a pump based on an intake loss that is identified through application of a physical model.

FIG. 4 is a schematic representation of a flow 400 for identifying a pump intake pressure before an intake for a pump based on an intake loss that is identified through application of a physical model. The flow 400 may be applied to an applicable production system to identify a pump intake pressure before an intake, such as the production systems shown in FIGS. 1 and 2.

At operation 402, a static head parameter of a pump of a production system in a wellbore may be identified. The static head parameter may be identified based on applicable characteristics of the production system related to static head. Specifically, the static head may be identified based on both the tubing length and pump length, such as the addition of both the tubing length and the pump length in the production system. As follows, the static head may be expressed as a unit of length. The static head parameter may be identified from an applicable source of information related to the static head parameter. For example, the static head parameter may be identified by a manufacturer of the production system or components of the production system, such as the pump.

At operation 404, a tubing loss parameter associated with production tubing of the production system may be identified. The tubing loss parameter may be identified based on applicable characteristics of the production system related to tubing loss. Specifically, the tubing loss parameter may be calculated based on production tubing length as well as operational parameters of the production system, such as an operating flowrate of the production system. Specifically, a tubing loss per unit of length may be determined based on characteristics of the production tubing and an operational flowrate of the production system. The tubing loss may be combined with the production tubing length to identify a total tubing loss corresponding to the tubing loss parameter. The tubing loss parameter may be expressed as a length unit of measurement, such as feet.

At operation 406, a wellhead head parameter of a wellhead of the wellbore may be identified. The wellhead head parameter may be identified by monitoring pressure at a wellhead of the wellbore, such as during operation of the production system. Specifically, the wellhead parameter may be identified based on measurements made by a pressure gauge at the wellhead of the wellbore.

At operation 408, a discharge head parameter of the production system may be identified. As discussed previously, the discharge head parameter corresponds to a pressure at a discharge of the pump of the production system. The discharge head parameter, as shown in the flow 400, is determined based on a combination of the static head parameter, the tubing loss parameter, and the wellhead head parameter. Specifically, the discharge head parameter may be determined by summing the wellhead head parameter, the tubing loss parameter, and the static head parameter. Each of these parameters may be in a length unit of measurement form. Specifically, the wellhead head parameter may be converted to a length unit of measurement by dividing the measured wellhead pressure by a specific gravity associated with a production substance. In various implementations the discharge head parameter may be identified through different methods.

At operation 410, a TDH parameter may be identified. As discussed previously, TDH parameter is a metric that represents the total distance that the pump may pump a production substance when viewed in the entire production system. Specifically, the TDH parameter may vary based on both an operational flowrate of the production system and an operational frequency of the production system.

The TDH parameter may be identified based on a production stage. Stages may be separated based on an operational frequency of the production system. For example, a stage may include while the production system is operating at 60 Hz. The TDH parameter may be identified by combining a pump head parameter across stages, such as by multiplying the pump head per stage by the number of pumping stages. The dynamic tracker 105 may use the TDH parameter value when detecting scaling and/or plugging of the production system 104. The dynamic tracker 105 may use the TDH parameter value as the required TDH for the production system. Hence, the dynamic tracker 105 may compute the required TDH for a given time, where the required TDH may depend on conditions and parameters in the well environment 100. Additional operations for detecting scaling and/or plugging in the production system 104 are further described herein.

At operation 412, a pump intake pressure after intake for the production system may be identified. Specifically, the pump intake pressure after intake may be identified based on both the discharge head determined at operation 408 and the TDH determined at operation 410. More specifically, the pump intake pressure after intake for the production system may include the difference between the discharge head parameter determined at operation 408 and the TDH parameter determined at operations 410. In various implementations, a pump intake pressure after intake may be identified through different methods.

At operation 414, a pump intake pressure before intake for the production system may be measured. The pump intake pressure before intake that is determined at operation 414 is read from sensor measurements made while the production system is deployed and operated in the wellbore. Specifically, the pump intake pressure before intake that is measured at operation 414 may be read from measurements made by one or more gauges deployed downhole with the production system, such as the gauge 208. As noted, the gauge 208 also may provide wellbore pressure measurements to the dynamic tracker 105 which may utilize the wellbore pressure measurements to determine a required TDH of the pump 204. The dynamic tracker 105 may use the required TDH in method for detecting scaling and/or plugging of the pump 204 based, in part, on the required TDH of the pump 204.

At operation 416, a calculated intake loss may be identified. Specifically, the calculated intake loss is identified based on the pump intake pressure before intake that is measured at operation 414 and the pump intake pressure after intake that is determined at operation 412. More specifically, the calculated intake loss may be the difference between the pump intake pressure before intake that is measured at operation 414 and the pump intake pressure after intake that is determined at operation 412. As the intake loss that is identified at operation 416 is determined based on the measured pump intake pressure before intake, the intake loss identified at operation 416 is referred to as a calculated intake loss.

At operation 418, a flowrate of the production system may be identified. The flowrate of the production system may be monitored during operation of the production system. Further, the flowrate of the production system may correspond to the pump intake pressure before intake that is measured at operation 414 and the corresponding calculated intake loss that is determined at operation 416. For example, measured pump intake pressures before intake and corresponding calculated intake losses may occur at specific measured flowrates of the production system.

In turn, the identified flowrate of the production system and the calculated intake loss may be used in generating a physical intake loss prediction model. Specifically, measured flowrates and corresponding calculated intake losses may serve as a basis for a physical intake loss prediction model. The physical intake loss prediction model may model flowrates of the production system to predicted intake loss values. The model may be specific to the production system, the production system disposed in the wellbore, the wellbore itself, a target production substance, or a combination thereof. In various implementations, other parameters distinct from the flowrate parameter may be used to generate the physical model.

At operation 420, the physical intake loss prediction model may be generated based on the calculated intake loss and the identified flowrate is applied to identify a virtual intake loss, such as predicted intake loss or determined real time intake loss. The intake loss may be identified separately from the intake loss that is calculated at operation 416. The virtual intake loss that is determined at operation 420 may be a distinct value from the calculated intake loss that is identified at operation 416. In applying a physical intake loss prediction model, a measured flowrate of the production system may be applied as input to the model for identifying the virtual intake loss.

At operation 422, a pump intake pressure before intake may be identified based on the virtual intake loss at operation 420 and the pump intake pressure after intake that is determined at operation 412. Specifically, the virtual intake loss may be summed with the identified pump intake pressure after intake to identify the pump intake pressure before intake at operation 422. The pump intake pressure after intake that is determined at operation 412 may be identified from measurements. Further and as shown in FIG. 4, the pump intake pressure before intake is not determined, at operation 422, directly from the pump intake pressure before intake that is measured at operation 414. As a result, the identified pump intake pressure before the intake is a distinct value from the measured pump intake pressure before the intake.

Figure 8:
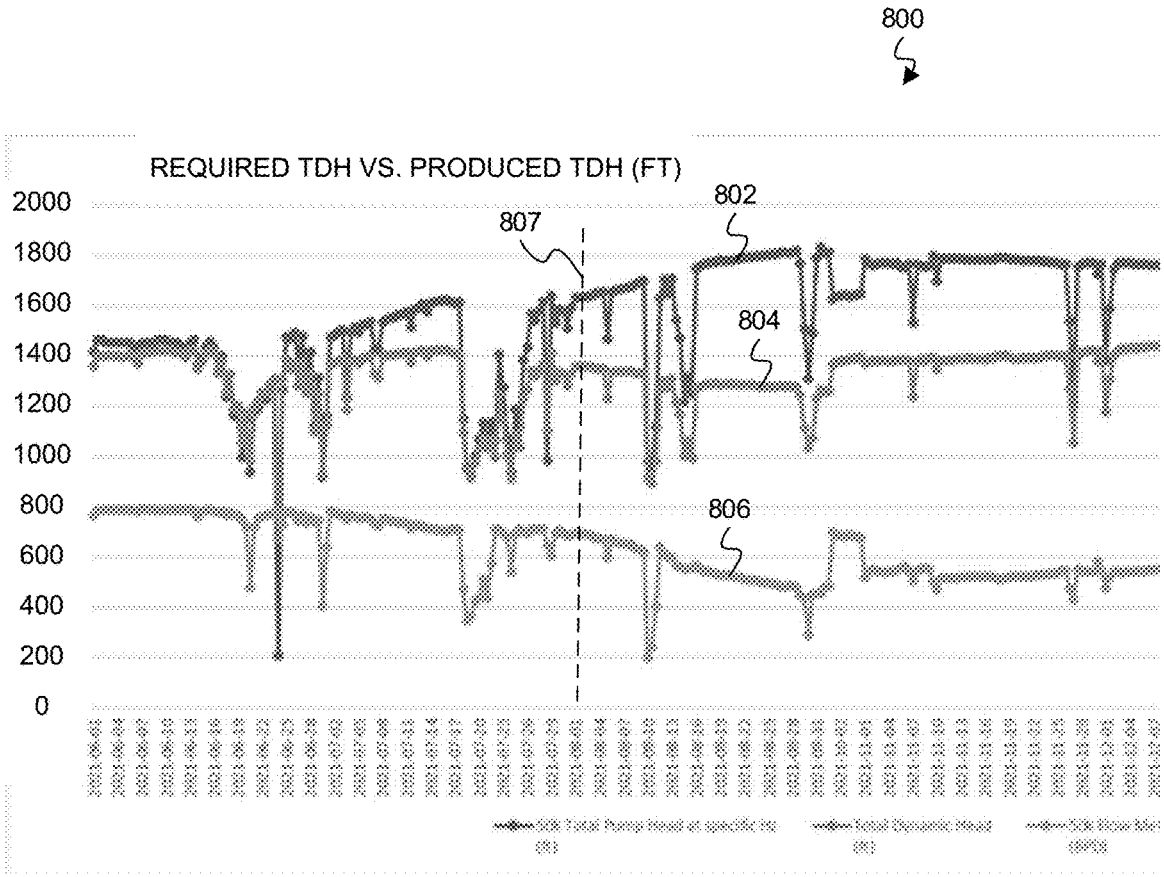
FIG. 8 is a graphical representation of example plots for a production system, where the plots include a required TDH plot, a produced TDH plot, and a flow rate plot.

For certain computations (such as produced TDH), the dynamic tracker 105 may use the pump intake pressure before the intake (422) as an estimate for wellbore pressure. This estimate for wellbore pressure (computed at 422) is based on virtual modeling and not a pressure measurement from in the wellbore. If the pump intake has plugging or scaling, the estimate for wellbore pressure may be inaccurate. For example, plugging or scaling may result in a wellbore pressure estimate that is erroneously low-thereby introducing error into an estimation of the pump's produced TDH because the wellbore pressure estimate may be used in estimating the pump's produced TDH. Hence, when the pump is plugged or scaled, estimates of produced TDH may be incorrect. For example, if the pump intake is occluded by plugging or scaling, the dynamic tracker 105 may estimate the wellbore pressure to be significantly lower than the actual wellbore pressure. Low estimated wellbore pressure may indicate that more lift is needed by the pump, so the dynamic tracker 105 may overestimate the pump's produced TDH. As the dynamic tracker 105 overestimates the pump's produced TDH, there is a divergence between the pump's required TDH and its produced TDH. This divergence indicates that the pump may have an issue with plugging or scaling. FIG. 8 describes how required TDH and produced TDH may diverge in a production system 104 operating in a wellbore.

FIG. 8 is a graphical representation of example plots for a production system, where the plots include a produced TDH plot, a required TDH plot, and a flow rate plot. A graph 800 includes the produced TDH plot 802, the required TDH plot 804, and the flow rate plot 806. The x-axis of the graph indicates increasing depth in feet from 0 to 2000. The y-axis indicates increasing dates, where the dates start at 2021 Jun. 1 and increment by 3 days until 2021 Dec. 7.

In the graph 800, viewing the plots from left to right, the produced TDH plot 802 and the required TDH plot 804 begin relatively close to each other. The dotted line 807 shows a date on which the produced TDH plot 802 diverges from the required TDH plot 804. When the produced TDH is greater than the required TDH, there may be plugging and/or scaling of the pump 116. As described with reference to FIG. 4, plugging or scaling may introduce error into various estimations made by the dynamic tracker 105, such as estimates of pump intake pressure before the intake (see discussion of block 422). Such erroneous estimations of pump intake pressure before the intake may cause erroneously large estimates for produced TDH that diverge from non-erroneous estimations of required TDH. As the produced TDH plot 802 diverges from the required TDH plot, the dynamic tracker 105 may present and indication that the production system 104 may have issues with scaling and/or plugging. In response, operators of the production system 104 may apply chemical treatments or take other action to remedy the scaling and/or plugging issues. In some implementations, the surface control system 106 may automatically apply the chemical treatment or take other action to address the scaling and/or plugging issues.

Figure 5:
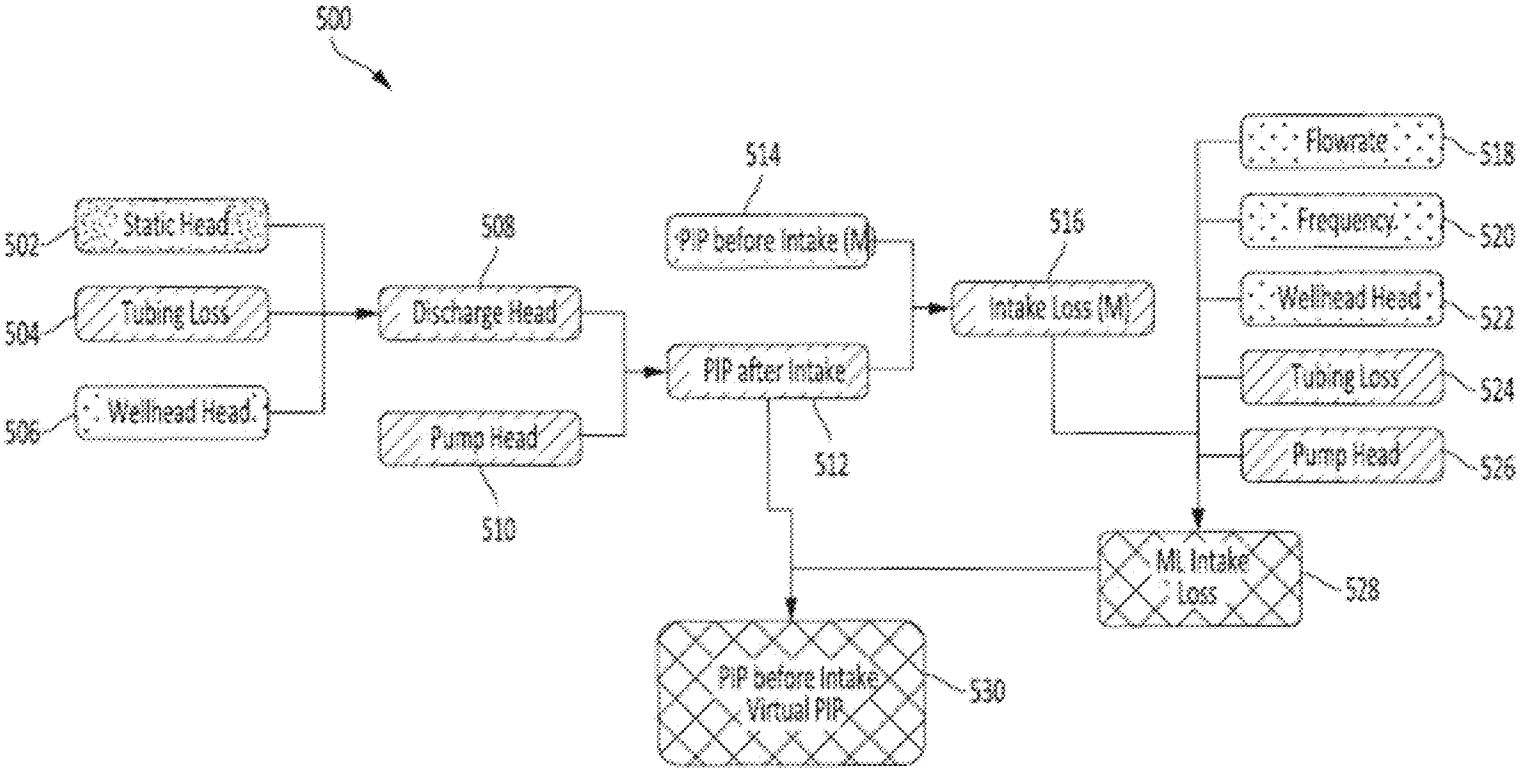
FIG. 5 is a schematic representation of a flow 500 for identifying a pump intake pressure before an intake for a pump based on an intake loss that is calculated through application of a machine learning-based model.

The discussion of FIG. 5 relates to implementations in which the production system 104 may compute various pressure-related parameters and other information using a learning machine. Just as the dynamic tracker 105 may utilize the physical model described with reference to FIG. 4, the dynamic track 105 also may utilize various pressure-related parameters and other information that have been determined by the learning machine (described with reference to FIG. 5).

FIG. 5 is a schematic representation of a flow 500 for identifying a pump intake pressure before an intake for a pump based on an intake loss that is calculated through application of a machine learning-based model. The flow 500 may be applied to an applicable production system to identify a pump intake pressure before an intake, such as the production systems shown in FIGS. 1 and 2.

Various operations in the flow 500 shown in FIG. 5 are the same operations as those performed in the flow 400 shown in FIG. 4. At operation 502, a static head parameter of a pump of a production system in a wellbore may be identified. At operation 504, a tubing loss parameter may be identified. At operation 506, a wellhead head parameter may be identified. At operation 508, a discharge head parameter may be identified. At operation 510, a TDH parameter may be identified. The dynamic tracker 105 may use the TDH parameter value used as the required TDH value. The required TDH value may be used to detect scaling and/or plugging in the production system 104. Hence, the dynamic tracker 105 may compute the required TDH for a given time, where the required TDH may depend on conditions and parameters in the well environment 100 (as described herein). Additional operations for detecting scaling and/or plugging in the production system 104 are further described herein.

At operation 512, a pump intake pressure after intake may be identified, such as calculated based on measurements. At operation 514, a pump intake pressure before intake may be measured. At operation 516, a calculated intake loss may be identified.

At operation 518, the flowrate parameter of the production system may be identified. At operation 520, the frequency parameter of the production system may be identified. At operation 522, the wellhead head parameter may be identified. At operation 524, the tubing loss parameter may be identified. At operation 526, the pump head parameter may be identified. In turn, a machine learning-based model may be generated based on one or a combination of the flowrate parameter, the frequency parameter, the wellhead head parameter, the tubing loss parameter, and the pump head parameter. Specifically, measured flowrates, measured operational frequencies, measured wellhead head, determined tubing loss, determined pump head, and corresponding measured intake losses may serve as a basis for a machine learning-based intake loss prediction model. In various implementations, other intake loss parameters may be used to generate the machine learning-based intake loss prediction model.

The model may be specific to the production system, the production system disposed in the wellbore, the wellbore itself, a target production substance, or a combination thereof. An applicable machine learning method may be applied to generate the machine learning-based intake loss prediction model. For example, and as will be discussed in greater detail later, the model may be generated through a neural network.

At operation 528, the machine learning-based intake loss prediction model may be applied to identify a virtual intake loss. The virtual intake loss may be identified separately from the calculated intake loss that may be identified at operation 516. In turn, the virtual intake loss that may be determined at operation 528 may be a distinct value from the calculated intake loss that may be identified at operation 516. In applying the machine learning-based intake loss prediction model, a measured flowrate of the production system, an operational frequency of the production system, a wellhead head of the production system, a tubing loss of the production system, a pump head of the production system, or a combination thereof may be applied as input to the model for determining the virtual intake loss.

At operation 530, a pump intake pressure before intake may be identified based on the virtual intake loss at operation 528 and the pump intake pressure after intake that may be determined at operation 512. Specifically, the predicted intake loss may be summed with the determined pump intake pressure after intake to identify the pump intake pressure before intake at operation 530. As shown in FIG. 5, the pump intake pressure before intake may be not identified, at operation 530, directly from the measured pump intake pressure before intake, that may be identified at operation 514. As a result, the predicted pump intake pressure before intake may be a distinct value from the measured pump intake pressure before intake. As described herein, the dynamic tracker 105 may use the pump intake pressure before the intake (422) as an estimate for wellbore pressure (as described herein).

Figure 6:
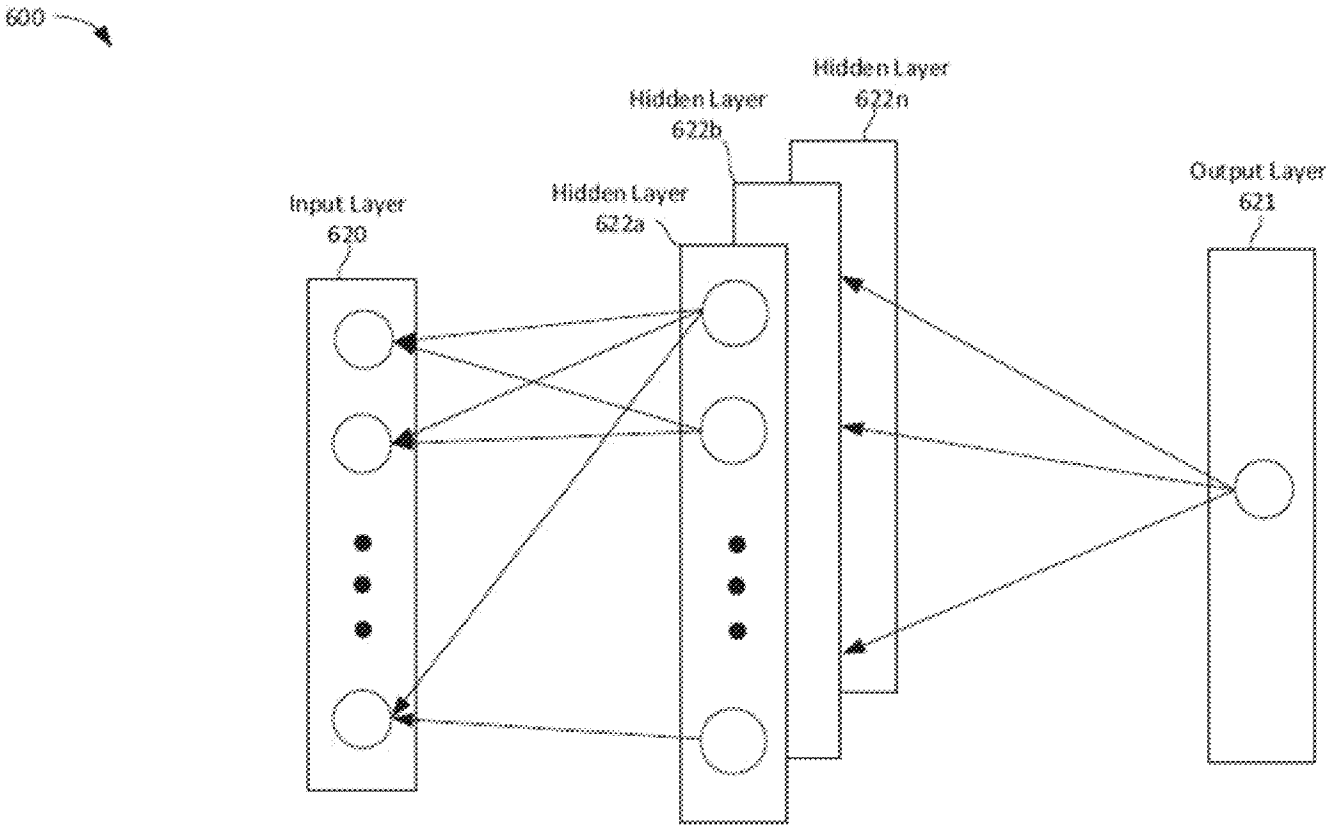
FIG. 6 is an example of a deep learning neural network that may be used to implement all or a portion of the systems and methods described herein.

In FIG. 6, the disclosure now turns to a further discussion of models that may be used through the environments and methods described herein. FIG. 6 is an example of a deep learning neural network 600 that may be used to implement all or a portion of the systems and methods described herein (e.g., neural network 600 may be used to implement a perception module (or perception system) as discussed above). An input layer 620 may be configured to receive sensor data and/or data relating to an environment. The neural network 600 includes multiple hidden layers 622*a*, 622*b*, through 622*n*. The hidden layers 622*a*, 622*b*, through 622*n* include "n" number of hidden layers, where "n" is an integer greater than or equal to one. The number of hidden layers may be made to include as many layers as needed for the given application. The neural network 600 further includes an output layer 621 that provides an output resulting from the processing performed by the hidden layers 622*a*, 622*b*, through 622*n*. In one illustrative example, the output layer 621 may provide estimated treatment parameters.

The neural network 600 is a multi-layer neural network of interconnected nodes. Each node may represent a piece of information. Information associated with the nodes is shared among the different layers and each layer retains information as information is processed. In some cases, the neural network 600 may include a feed-forward network, in which case there are no feedback connections where outputs of the network are fed back into itself. In some cases, the neural network 600 may include a recurrent neural network, which may have loops that allow information to be carried across nodes while reading in input.

Information may be exchanged between nodes through node-to-node interconnections between the various layers. Nodes of the input layer 620 may activate a set of nodes in the first hidden layer 622*a*. For example, as shown, each of the input nodes of the input layer 620 is connected to each of the nodes of the first hidden layer 622*a*. The nodes of the first hidden layer 622*a* may transform the information of each input node by applying activation functions to the input node information. The information derived from the transformation may then be passed to and may activate the nodes of the next hidden layer 622*b*, which may perform their own designated functions. Example functions include convolutional, up-sampling, data transformation, and/or any other suitable functions. The output of the hidden layer 622*b* may then activate nodes of the next hidden layer, and so on. The output of the last hidden layer 622*n* may activate one or more nodes of the output layer 621, at which an output is provided. In some cases, while nodes in the neural network 600 are shown as having multiple output lines, a node may have a single output and all lines shown as being output from a node represent the same output value.

In some cases, each node or interconnection between nodes may have a weight that is a set of parameters derived from the training of the neural network 600. Once the neural network 600 is trained, it may be referred to as a trained neural network, which may be used to classify one or more activities. For example, an interconnection between nodes may represent a piece of information learned about the interconnected nodes. The interconnection may have a tunable numeric weight that may be tuned (e.g., based on a training dataset), allowing the neural network 600 to be adaptive to inputs and able to learn as more and more data is processed.

The neural network 600 is pre-trained to process the features from the data in the input layer 620 using the different hidden layers 622*a*, 622*b*, through 622*n* in order to provide the output through the output layer 621.

In some cases, the neural network 600 may adjust the weights of the nodes using a training process called back-propagation. A backpropagation process may include a forward pass, a loss function, a backward pass, and a weight update. The forward pass, loss function, backward pass, and parameter/weight update is performed for one training iteration. The process may be repeated for a certain number of iterations for each set of training data until the neural network 600 is trained well enough so that the weights of the layers are accurately tuned.

To perform training, a loss function may be used to analyze error in the output. Any suitable loss function definition may be used, such as a Cross-Entropy loss. Another example of a loss function includes the mean squared error (MSE), defined as $E_total=\Sigma(\frac{1}{2}(target-output)^2)$. The loss may be set to be equal to the value of $E_total$.

The loss (or error) will be high for the initial training data since the actual values will be much different than the predicted output. The goal of training is to minimize the amount of loss so that the predicted output is the same as the training output. The neural network 600 may perform a backward pass by determining which inputs (weights) most contributed to the loss of the network and may adjust the weights so that the loss decreases and is eventually minimized.

The neural network 600 may include any suitable deep network. One example includes a Convolutional Neural Network (CNN), which includes an input layer and an output layer, with multiple hidden layers between the input and out layers. The hidden layers of a CNN include a series of convolutional, nonlinear, pooling (for down sampling), and fully connected layers. The neural network 600 may include any other deep network other than a CNN, such as an autoencoder, Deep Belief Nets (DBNs), Recurrent Neural Networks (RNNs), among others.

As understood by those of skill in the art, machine-learning based classification methods may vary depending on the desired implementation. For example, machine-learning classification schemes may utilize one or more of the following, alone or in combination: hidden Markov models; RNNs; CNNs; deep learning; Bayesian symbolic methods; Generative Adversarial Networks (GANs); support vector machines; image registration methods; and applicable rule-based systems. Where regression algorithms are used, they may include but are not limited to: a Stochastic Gradient Descent Regressor, a Passive Aggressive Regressor, etc.

Machine learning classification models may also be based on clustering algorithms (e.g., a Mini-batch K-means clustering algorithm), a recommendation algorithm (e.g., a Min-wise Hashing algorithm, or Euclidean Locality-Sensitive Hashing (LSH) algorithm), and/or an anomaly detection algorithm, such as a local outlier factor. Additionally, machine-learning models may employ a dimensionality reduction approach, such as, one or more of: a Mini-batch Dictionary Learning algorithm, an incremental Principal Component Analysis (PCA) algorithm, a Latent Dirichlet Allocation algorithm, and/or a Mini-batch K-means algorithm, etc.

Figure 7:
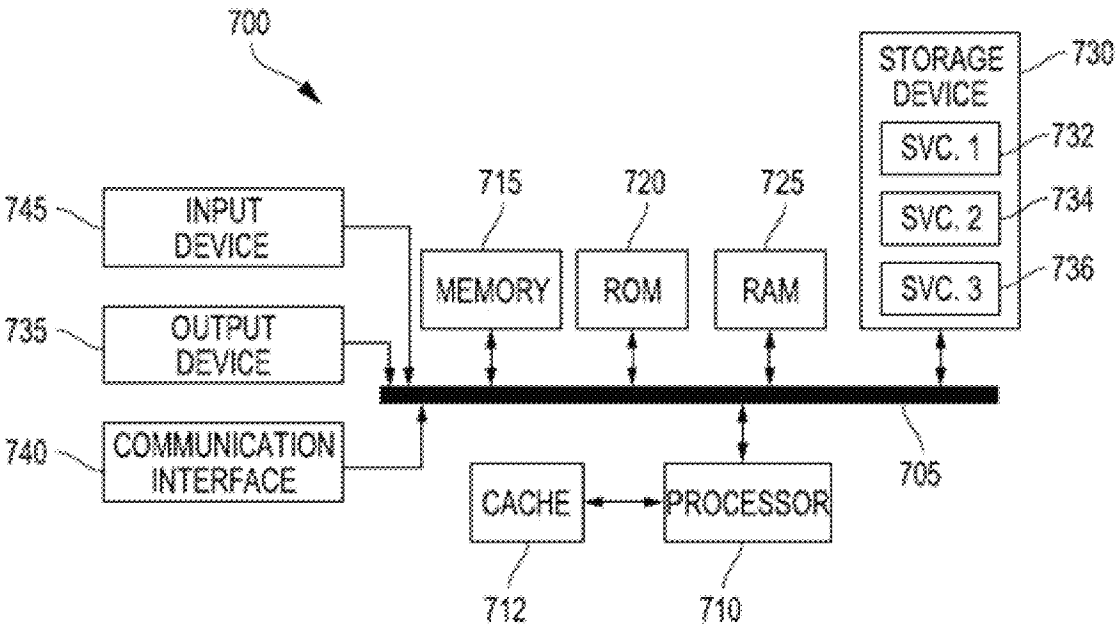
FIG. 7 illustrates an example computing device architecture 700 which may be employed to perform various operations and methods disclosed herein.

FIG. 7 illustrates an example computing device architecture 700 which may be employed to perform various operations, methods, and methods disclosed herein. The various implementations will be apparent to those of ordinary skill in the art when practicing the present technology. Persons of ordinary skill in the art will also readily appreciate that other system implementations or examples are possible.

As noted above, FIG. 7 illustrates an example computing device architecture 700 of a computing device which may implement the various technologies and methods described herein. The components of the computing device architecture 700 are shown in electrical communication with each other using a connection 705, such as a bus. The example computing device architecture 700 includes a processing unit (CPU or processor) 710 and a computing device connection 705 that couples various computing device components including the computing device memory 715, such as read only memory (ROM) 720 and random access memory (RAM) 725, to the processor 710. In some implementations, the dynamic tracker 105 may reside in any of the components shown in FIG. 7. For example, the dynamic tracker 105 may include instructions residing on the storage device 730 and/or in the memory 715, where the instructions are executable by the processor 710. In some implementations, the dynamic tracker 105 may include a hardware device coupled with the connection 705, where the hardware device is capable of the operations described herein.

The computing device architecture 700 may include a cache of high-speed memory connected directly with, near, or integrated as part of the processor 710. The computing device architecture 700 may copy data from the memory 715 and/or the storage device 730 to the cache 712 for quick access by the processor 710. In this way, the cache may provide a performance boost that avoids processor 710 delays while waiting for data. These and other modules may control or be configured to control the processor 710 to perform various actions. Other computing device memory 715 may be available for use as well. The memory 715 may include multiple different types of memory with different performance characteristics. The processor 710 may include any general purpose processor and a hardware or software service, such as service 1 732, service 2 734, and service 3 736 stored in storage device 730, configured to control the processor 710 as well as a special-purpose processor where software instructions are incorporated into the processor design. The processor 710 may be a self-contained system, containing multiple cores or processors, a bus, memory controller, cache, etc. A multi-core processor may be symmetric or asymmetric.

To enable user interaction with the computing device architecture 700, an input device 745 may represent any number of input mechanisms, such as a microphone for speech, a touch-sensitive screen for gesture or graphical input, keyboard, mouse, motion input, speech and so forth. An output device 735 may also be one or more of a number of output mechanisms known to those of skill in the art, such as a display, projector, television, speaker device, etc. In some instances, multimodal computing devices may enable a user to provide multiple types of input to communicate with the computing device architecture 700. The communications interface 740 may generally govern and manage the user input and computing device output. There is no restriction on operating on any particular hardware arrangement and therefore the basic features here may easily be substituted for improved hardware or firmware arrangements as they are developed.

Storage device 730 is a non-volatile memory and may be a hard disk or other types of computer readable media which may store data that are accessible by a computer, such as magnetic cassettes, flash memory cards, solid state memory devices, digital versatile disks, cartridges, random access memories (RAMs) 725, read only memory (ROM) 720, and hybrids thereof. The storage device 730 may include services 732, 734, 736 for controlling the processor 710. Other hardware or software modules are contemplated. The storage device 730 may be connected to the computing device connection 705. In one aspect, a hardware module that performs a particular function may include the software component stored in a computer-readable medium in connection with the necessary hardware components, such as the processor 710, connection 705, output device 735, and so forth, to carry out the function.

Methods of Some Implementations

Figure 9:
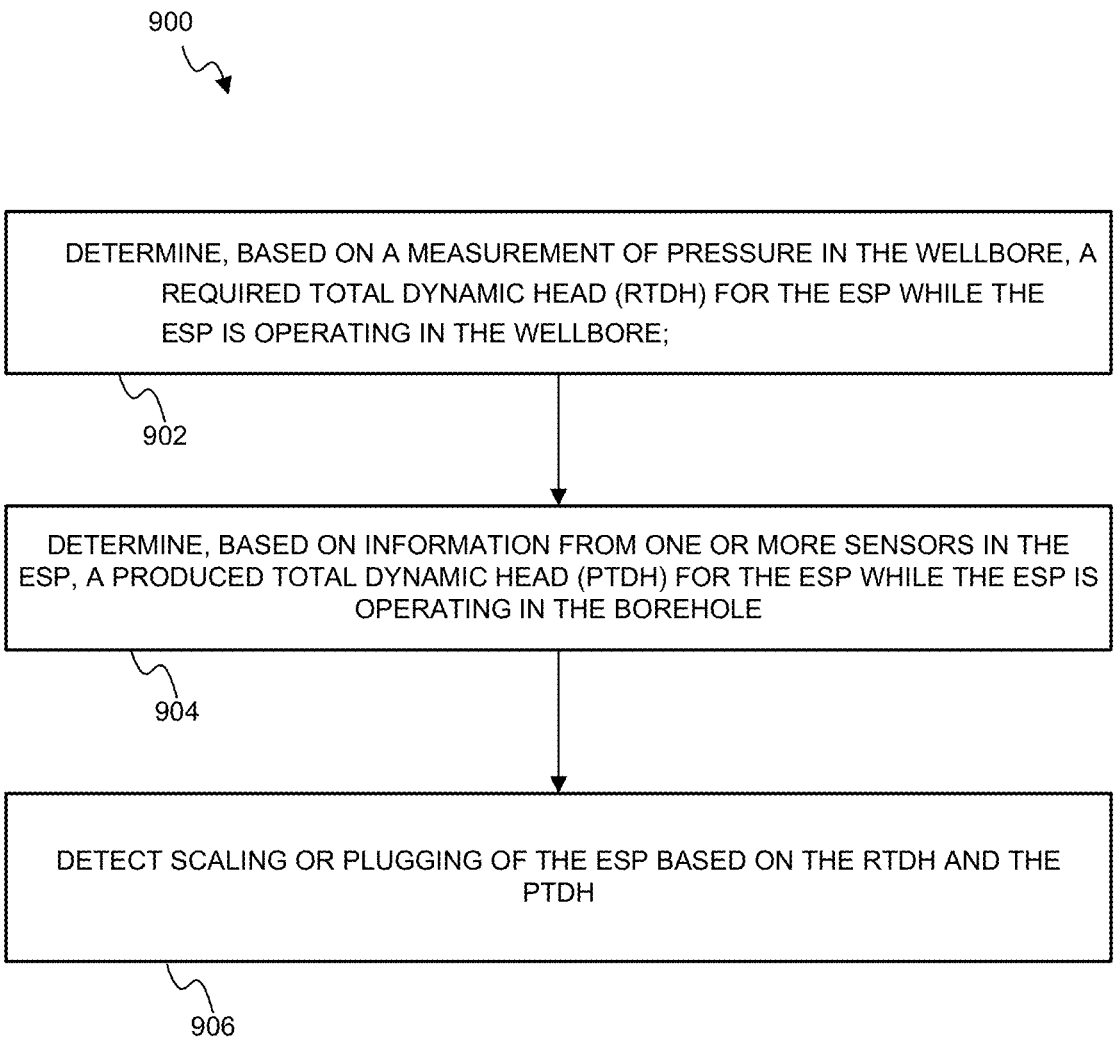
FIG. 9 is a flow diagram illustrating operations for a method for controlling a computer system configured to detect scaling and/or plugging of an electric submersible pump (ESP) deployed in a wellbore.

FIG. 9 is a flow diagram illustrating operations for a method for controlling a computer system configured to detect scaling and/or plugging of an electric submersible pump (ESP) deployed in a wellbore. A flow 900 begins at block 902. At block 902, the dynamic tracker 105 may determine, based on a measurement of pressure in the wellbore, a required total dynamic head (RTDH) for the ESP while the ESP is operating in the wellbore. At block 904, the dynamic tracker 105 may determine, based on information from one or more sensors in the ESP, a produced total dynamic head (PTDH) for the ESP while the ESP is operating in the borehole. At block 906, the dynamic tracker 105 may detect scaling status and/or plugging status of the ESP based on the RTDH and the PTDH. Scaling/plugging status may indicate there is no scaling/plugging, a degree of scaling/plugging, or any useful status of scaling/plugging. In some implementations, the scaling/plugging status is a binary value indicating either there is enough scaling to require remedial action in the wellbore or there is not enough scaling to require remedial action. In some implementations, the production system 104 itself may automatically take actions to address the scaling and/or plugging, such as by applying chemical treatments to one or more of the ESP and other components in the wellbore.

General Comments

For clarity of explanation, in some instances the present technology may be presented as including individual functional blocks including functional blocks comprising devices, device components, operations or routines in a method embodied in software, or combinations of hardware and software.

In some implementations the computer-readable storage devices, mediums, and memories may include a cable or wireless signal containing a bit stream and the like. However, when mentioned, non-transitory computer-readable storage media expressly exclude media such as energy, carrier signals, electromagnetic waves, and signals per se.

Methods according to the above-described examples may be implemented using computer-executable instructions that are stored or otherwise available from computer readable media. Such instructions may include, for example, instructions and data which cause or otherwise configure a general purpose computer, special purpose computer, or a processing device to perform a certain function or group of functions. Portions of computer resources used may be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures may include hardware, firmware and/or software, and may take any of a variety of form factors. Typical examples of such form factors include laptops, smart phones, small form factor personal computers, personal digital assistants, rackmount devices, standalone devices, and so on. Functionality described herein also may be embodied in peripherals or add-in cards. Such functionality may also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific implementations thereof, but those skilled in the art will recognize that the application is not limited thereto. Thus, while illustrative implementations of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, implementations may be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate implementations, the methods may be performed in a different order than that described.

Where components are described as being "configured to" perform certain operations, such configuration may be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm operations described in connection with the examples disclosed herein may be implemented as electronic hardware, computer software, firmware, or combinations thereof. To clearly illustrate this interchangeability of hardware and software, various illustrative components, blocks, modules, circuits, and operations have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The methods described herein may also be implemented in electronic hardware, computer software, firmware, or any combination thereof. Such methods may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the methods may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The methods additionally, or alternatively, may be realized at least in part by a computer-readable communication medium that carries or communicates program code in the form of instructions or data structures and that may be accessed, read, and/or executed by a computer, such as propagated signals or waves.

Other implementations of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Implementations may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate implementations are illustrated such that the orientation is such that the right-hand side is downhole compared to the left-hand side.

The term "coupled" is defined as connected, whether directly or indirectly through intervening components, and is not necessarily limited to physical connections. The connection may be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but may have one or more deviations from a true cylinder.

The term "radially" means substantially in a direction along a radius of the object or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method operations, it is to be understood that the subject matter defined in the appended claims is not necessarily limited to these described features or acts. Such functionality may be distributed differently or performed in components other than those identified herein. The described features and operations are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

More Example Implementations

The following clauses describe some implementations.

Clause 1: A method for controlling a computer system configured to detect scaling and/or plugging of an electric submersible pump (ESP) deployed in a wellbore, the method comprising: determining, based on a measurement of pressure in the wellbore, a required total dynamic head (RTDH) for the ESP while the ESP is operating in the wellbore; determining, based on information from one or more sensors in the ESP, a produced total dynamic head (PTDH) for the ESP while the ESP is operating in the wellbore; and detecting scaling status or plugging status of the ESP based on the RTDH and the PTDH.

Clause 2: The method of clause 1 further comprising: in response to detecting the scaling status or plugging status of the ESP, taking an action to address the scaling status or plugging status of the ESP in the wellbore.

Clause 3: The method of any one or more of clauses 1-3 further comprising: after a chemical treatment, determining another value for RTDH and another value for PTDH while the ESP is operating in the wellbore; and detecting effects of a chemical treatment of the ESP based on the other values for RTDH and PTDH.

Clause 4: The method of any one or more of clauses 1-3, wherein the RTDH and PTDH are determined in real time while the ESP is operating.

Clause 5: The method of any one or more of clauses 1-4, wherein the RTDH is an estimate of lift needed for the ESP to pump fluid in the wellbore to a discharge at surface at a particular time, wherein the PTDH is an estimate of lift being produced by the ESP at the particular time.

Clause 6: The method of any one or more of clauses 1-5 further comprising: determining a ratio of the RTDH to the PTDH, wherein the detecting the scaling status or plugging status of the ESP is based on the ratio of the RTDH.

Clause 7: The method of any one or more of clauses 1-6 further comprising: determining, for the scaling status or the plugging status, there is no scaling or plugging of the ESP if a ratio of PTDH to RTDH is at least one.

Clause 8: The method of any one or more of clauses 1-7, wherein previous well data indicates one or more ratios at which the scaling status and plugging status indicate no scaling or plugging of the ESP.

Clause 9: The method of any one or more of clauses 1-8 further comprising: setting an alarm based on the ratio of PTDH to RTDH, wherein the alarm activates when the ratio exceeds a specified threshold ratio, and wherein the threshold ratio depends on one or more of well conditions and equipment size.

Clause 10: A non-transitory machine-readable medium including computer-executable instructions for controlling a computer system to detect scaling and/or plugging of an electric submersible pump (ESP) deployed in a wellbore, the instructions comprising: instructions to determine, based on a measurement of pressure in the wellbore, a required total dynamic head (RTDH) for the ESP while the ESP is operating in the borehole; instructions to determine, based on information from one or more sensors in the ESP, a produced total dynamic head (PTDH) for the ESP while the ESP is operating in the borehole; and instructions to detect scaling status or plugging status of the ESP based on the RTDH and the PTDH.

Clause 11: The machine-readable medium of any one or more of clauses 10, further comprising: instructions to, in response to detection of scaling status or plugging status of the ESP, take an action to address the scaling status or plugging status of the ESP in the wellbore.

Clause 12: The machine-readable medium of any one or more of clauses 10-11, wherein the RTDH and PTDH are determined in real time while the ESP is operating.

Clause 13: The machine-readable medium of any one or more of clauses 10-12, further comprising: instructions to determine a ratio of the RTDH to the PTDH, wherein the detection of the scaling or plugging of the ESP is based on the ratio of the RTDH to the PTDH and on well conditions when the RTDH and PTDH were determined.

Clause 14: The machine-readable medium of any one or more of clauses 10-13, further comprising: instructions to determine there is no scaling or plugging of the ESP if a ratio of PTDH to RTDH is at least one.

Clause 15: The machine-readable medium of any one or more of clauses 10-14, wherein previous well data indicates one or more ratios at which the scaling status and plugging status indicate no scaling or plugging of the ESP.

Clause 16: The machine-readable medium of any one or more of clauses 10-15, wherein previous well data indicates one or more ratios at which the scaling status and plugging status indicate no scaling or plugging of the ESP.

Clause 17: A system comprising: a processor; a non-transitory machine-readable medium including instructions executable on the processor for controlling the system to detect scaling and/or plugging of an electric submersible pump (ESP) deployed in a wellbore, the instructions including instructions to determine, based on a measurement of pressure in the wellbore, a required total dynamic head (RTDH) for the ESP while the ESP is operating in the borehole; instructions to determine, based on information from one or more sensors in the ESP, a produced total dynamic head (PTDH) for the ESP while the ESP is operating in the borehole; and instructions to detect scaling status or plugging status of the ESP based on the RTDH and the PTDH.

Clause 18: A system of clause 17 further comprising: instructions to, in response to detecting the scaling status or plugging status of the ESP, take an action to address the scaling status or plugging status of the ESP in the wellbore.

Clause 19: The system of any one or more of clauses 17-18, wherein the RTDH and PTDH are determined in real time while the ESP is operating.

Clause 20: The system of any one or more of clauses 17-19 further comprising: instructions to, after a chemical treatment, determining another value for RTDH and another value for PTDH while the ESP is operating in the wellbore; and instructions to detect effects of a chemical treatment of the ESP based on the other values for RTDH and PTDH.

What is claimed is:

1. A method for controlling a computer system configured to detect scaling and/or plugging of an electric submersible pump (ESP) deployed in a wellbore, the method comprising:

determining, based on a measurement of pressure in the wellbore, a required total dynamic head (RTDH) for the ESP while the ESP is operating in the wellbore;

determining, based on information from one or more sensors in the ESP, a produced total dynamic head (PTDH) for the ESP while the ESP is operating in the wellbore; and determining scaling status or plugging status of the ESP based on the RTDH and the PTDH.

2. The method of claim 1 further comprising:

in response to determining the scaling status or plugging status of the ESP, taking an action to address the scaling status or plugging status of the ESP in the wellbore.

3. The method of claim 1 further comprising:

after a chemical treatment, determining another value for RTDH and another value for PTDH while the ESP is operating in the wellbore; and detecting effects of a chemical treatment of the ESP based on the other values for RTDH and PTDH.

4. The method of claim 1, wherein the RTDH and PTDH are determined in real time while the ESP is operating.

5. The method of claim 1, wherein the RTDH is an estimate of lift needed for the ESP to pump fluid in the wellbore to a discharge at surface at a particular time, and wherein the PTDH is an estimate of lift being produced by the ESP at the particular time.

6. The method of claim 5 further comprising:

determining a ratio of the RTDH to the PTDH, wherein the detecting the scaling status or plugging status of the ESP is based on the ratio of the RTDH to the PTDH and on well conditions when the RTDH and PTDH were determined.

7. The method of claim 6 further comprising:

determining, for the scaling status or the plugging status, there is no scaling or no plugging of the ESP if a ratio of PTDH to RTDH is at least one.

8. The method of claim 6, wherein previous well data indicates one or more ratios at which the scaling status and plugging status indicate no scaling or no plugging of the ESP.

9. The method of claim 8 further comprising:

setting an alarm based on the ratio of PTDH to RTDH, wherein the alarm activates when the ratio exceeds a specified threshold ratio, and wherein the threshold ratio depends on one or more of well conditions and equipment size.

10. A non-transitory machine-readable medium including computer-executable instructions for controlling a computer system to detect scaling and/or plugging of an electric submersible pump (ESP) deployed in a wellbore, the instructions comprising:

instructions to determine, based on a measurement of pressure in the wellbore, a required total dynamic head (RTDH) for the ESP while the ESP is operating in the borehole;

instructions to determine, based on information from one or more sensors in the ESP, a produced total dynamic head (PTDH) for the ESP while the ESP is operating in the borehole; and instructions to determine scaling status or plugging status of the ESP based on the RTDH and the PTDH.

11. The non-transitory machine-readable medium of claim 10 further comprising:

instructions to, in response to determination of the scaling status or the plugging status of the ESP, take an action to address the scaling status or the plugging status of the ESP in the wellbore.

12. The non-transitory machine-readable medium of claim 11, wherein previous well data indicates one or more ratios at which the scaling status and plugging status indicate no scaling or no plugging of the ESP.

13. The non-transitory machine-readable medium of claim 10, wherein the RTDH and PTDH are determined in real time while the ESP is operating.

14. The non-transitory machine-readable medium of claim 10 further comprising:

instructions to determine a ratio of the RTDH to the PTDH, wherein the detection of the scaling or plugging of the ESP is based on the ratio of the RTDH to the PTDH and on well conditions when the RTDH and PTDH were determined.

15. The non-transitory machine-readable medium of claim 10 further comprising:

instructions to determine there is no scaling or plugging of the ESP if a ratio of PTDH to RTDH is at least one.

16. The non-transitory machine-readable medium of claim 10, wherein previous well data indicates one or more ratios at which the scaling status and plugging status indicate no scaling or no plugging of the ESP.

17. A system comprising:

a processor;

a non-transitory machine-readable medium including instructions executable on the processor for controlling the system to detect scaling and/or plugging of an electric submersible pump (ESP) deployed in a wellbore, the instructions including instructions to determine, based on a measurement of pressure in the wellbore, a required total dynamic head (RTDH) for the ESP while the ESP is operating in the borehole;

instructions to determine, based on information from one or more sensors in the ESP, a produced total dynamic head (PTDH) for the ESP while the ESP is operating in the borehole; and instructions to detect scaling status or plugging status of the ESP based on the RTDH and the PTDH.

18. The system of claim 17 further comprising:

instructions to, in response to detecting the scaling status or plugging status of the ESP, take an action to address the scaling status or plugging status of the ESP in the wellbore.

19. The system of claim 17, wherein the RTDH and PTDH are determined in real time while the ESP is operating.

20. The system of claim 17 further comprising:

instructions to, after a chemical treatment, determining another value for RTDH and another value for PTDH while the ESP is operating in the wellbore; and instructions to detect effects of a chemical treatment of the ESP based on the other values for RTDH and PTDH.

* * * * *